US005194702A

United States Patent [19]

Swonger, Jr.

[11] Patent Number: 5,194,702

[45] Date of Patent: Mar. 16, 1993

[54] VERTICALLY SCROLLED ELEVATOR POSITION INDICATOR

[76] Inventor: Karl W. Swonger, Jr., 2806 Merrimac Blvd., Toledo, Ohio 43606

[21] Appl. No.: 761,273

[22] Filed: Sep. 17, 1991

[51] Int. Cl.[5] ..... B66B 3/00

[52] U.S. Cl. ..... 187/139; 187/101; 187/130; 187/134

[58] Field of Search ..... 187/139, 101, 130, 134

[56] References Cited

U.S. PATENT DOCUMENTS 3,740,709 6/1973 Savino .
3,783,957 1/1974 Borghi .
3,898,611 8/1975 Mandel .
4,163,332 8/1979 Salam .
4,164,271 8/1979 Bergstrom .
4,298,869 11/1981 Okuno .
4,380,879 4/1983 Seibert .
4,389,804 6/1983 Seibert et al. .
4,471,356 9/1984 Gidl .
4,630,026 12/1986 Lewis .
4,660,031 4/1987 Buchas .
4,683,990 8/1987 Wright .
4,724,933 2/1988 Tsuji et al. .
4,832,157 5/1989 Kitano .
4,852,696 8/1989 Fukuda ..... 187/139
4,958,707 9/1990 Yoneda et al. ..... 187/101
5,056,629 10/1991 Tsuji ..... 187/139

*Primary Examiner*—Steven L. Stephan
*Assistant Examiner*—Thomas M. Dougherty
*Attorney, Agent, or Firm*—MacMillan, Sobanski & Todd

[57] ABSTRACT

An elevator car position indicator display is controlled by a microprocessor to display a stationary position indicator character when the car is stationary and to vertically scroll the position indicator character across the display when the car is in motion. In the preferred embodiment, the display is scrolled downwardly when the car is ascending and upwardly when the car is descending. The scrolling imparts a visual sense of motion and direction to the car passengers. The display can also be used to transmit messages which can be alternated with the car position indicator.

14 Claims, 5 Drawing Sheets

VERTICALLY SCROLLED ELEVATOR POSITION INDICATOR

BACKGROUND OF THE INVENTION

This invention relates generally to an elevator position display and, in particular, to a microprocessor-controlled digital display.

Elevator cars are usually equipped with position indicator displays to inform passengers of the car location. The displays are often a part of the elevator control system and are updated as position sensors located along the elevator shaft are passed by the elevator car. The displays usually include static alphanumeric characters of a single color which correspond to the closest floor. The characters are changed as a particular floor is reached or passed. Thus, the display changes in discrete steps.

Originally, the elevators position was indicated by a mechanical pointer or numbered markers. The mechanical indicators were replaced by electronically operated devices. Initially, the electronic devices used lighted gas filled tubes or incandesent lights for displaying the car location. Then, when light emitting diodes became brighter and had longer lives, the gas filled tubes were replaced by light emitting diodes. The light emitting diodes may be arranged to form numerals. A supplemental indicator is usually required to show the car direction. For example, a separate green arrow may be illuminated for upward travel and a red arrow, for downward travel.

Elevator cars are also equipped with an emergency stop or emergency alarm button. When an emergency button is pressed, a bell rings to provide a audible indication of a car in trouble. However, if there are multiple cars in a common hoistway space, it is difficult to identify which cars bell is ringing. Furthermore, a deaf person would be unable to tell if the alarm has been sounded. While some elevator installations include a separate alarm indicator light in a lobby panel or security console, such indicators are an added expense. Because of the expense, many elevator installations rely only on the audible alarm.

SUMMARY OF THE INVENTION

This invention relates to an improved elevator car position indicator display which includes vertical scrolling of a position indicating character when the elevator car is in motion. The character will scroll in a downward direction when the car ascends; and, in an upward direction when the car descends. Characters representing intermediate floors scroll across the display as the car moves from the originating floor to the destination floor. This informs the car occupants of their exact location. Thus, a visual sense of motion and direction is imparted to the elevator car passengers. The scrolling rate is timed such that a new character representative of the current car position is fully displayed when the car arrives at the desired floor. While the position indicator character is scrolled across the display, a portion of the display may be held stationary. For example, a stationary arrow indicative of the car's direction of movement can be displayed next to the character being scrolled. When the car is stopped at a floor, a stationary character is displayed.

While the primary location for the display is in the elevator car for use by car occupants, duplicate displays can be located remotely from the car. Typical locations for remote displays include a central security console, a lobby panel and at each car landing.

A microprocessor is used to animate the display. Codes which are used by the microprocessor to display the appropriate characters are stored in a memory element. The microprocessor can also cause a display of messages which are alternated with the position indication. Thus, the position indicator can provide a visual verification of an emergency button activation for a deaf person who cannot hear the alarm bell. The message would also appear on the displays located at each car landing and thus be available throughout the building. In a situation in which there is a group of elevator cars, the message would clarify which car is in need of assistance. This feature is especially useful when there is no lobby panel or central security console to display the problem location.

One embodiment of the display would use a screen consisting of a matrix of Light Emitting Diodes (LEDs). Selected LEDs would be illuminated to display the position indicating character. Further, different colors of LEDs could be grouped to form individual matrix elements. This would permit use of color for symbols and for a contrasting background. Also, the character and background colors could be reversed as an additional message indicator or to draw attention to a particular display.

Other objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
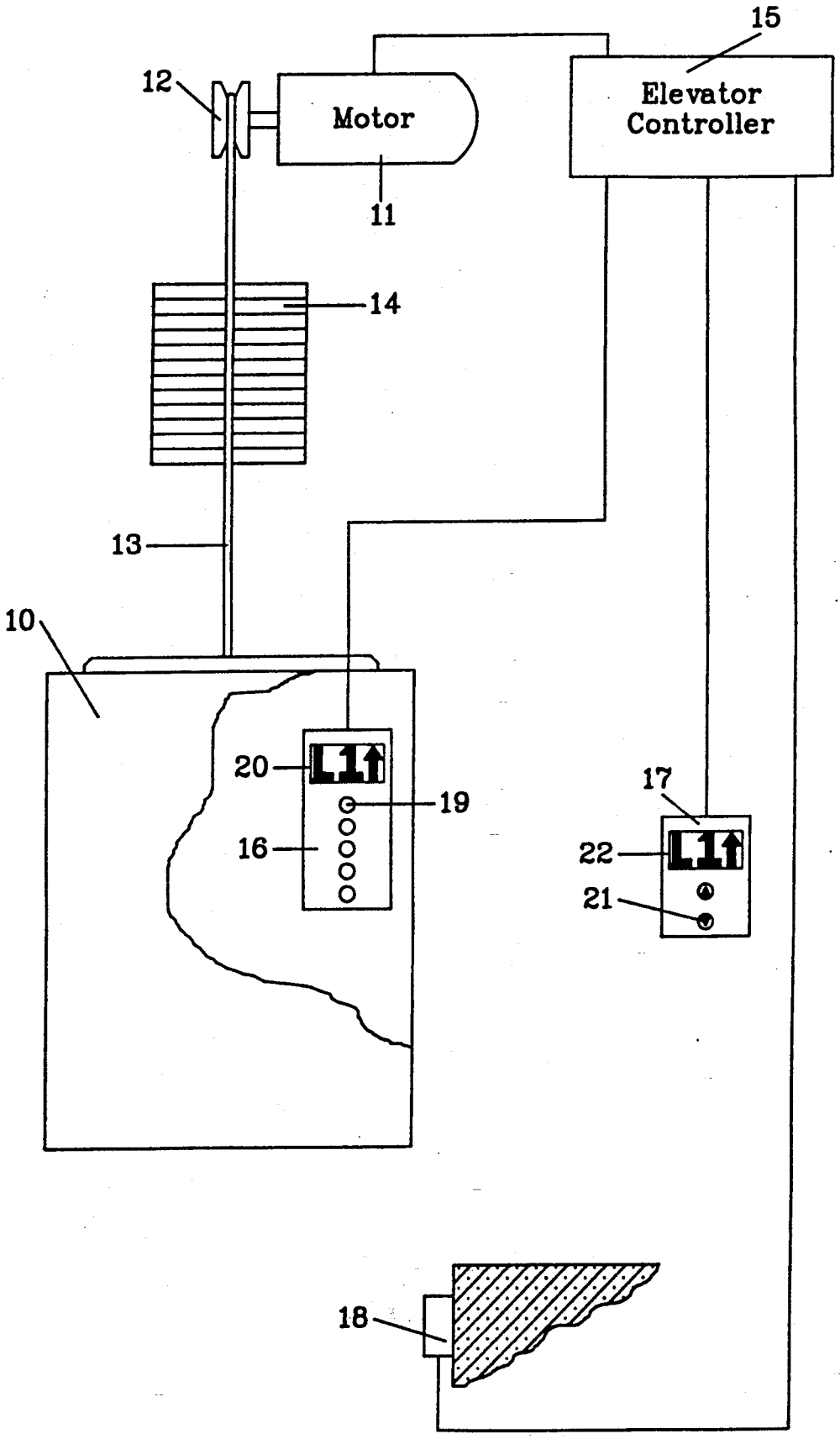
FIG. 1 shows a typical elevator installation which includes the invention.

Referring now to FIG. 1, there is illustrated a typical elevator installation which includes the invention. While only one elevator car is shown, there may be any number of cars involved, as in a large office building. An elevator car 10 is raised and lowered vertically in a elevator shaft (not shown) by a motor 11 turning a pulley 12 over which a hoisting cable 13 passes. The weight of the car 10 is counterbalanced by weights 14 attached to the hoisting cable 13 to reduce the motor size. The motor 11 is controlled by an elevator controller 15 which is responsive to signals received from a control panel 16 mounted in the car, landing control panels 17 located on each floor (one shown) and position sensors 18 (one shown) located in the elevator shaft. The elevator car control panel 16 typically includes a number of pushbuttons 19 for requesting a destination floor and for signaling. The panel 16 would also include a car position display screen 20 to indicate the position of the car 10 within the elevator shaft.

While the display screen 20 is shown in FIG. 1 as part of the control panel 16, the screen 20 may be separately located from the panel 16. The landing panel 17 would typically include two call buttons 21 and a car position display screen 22. The control of the elevator car 10 by means of the elevator controller 15 is well known in the conventional art.

Figure 2:
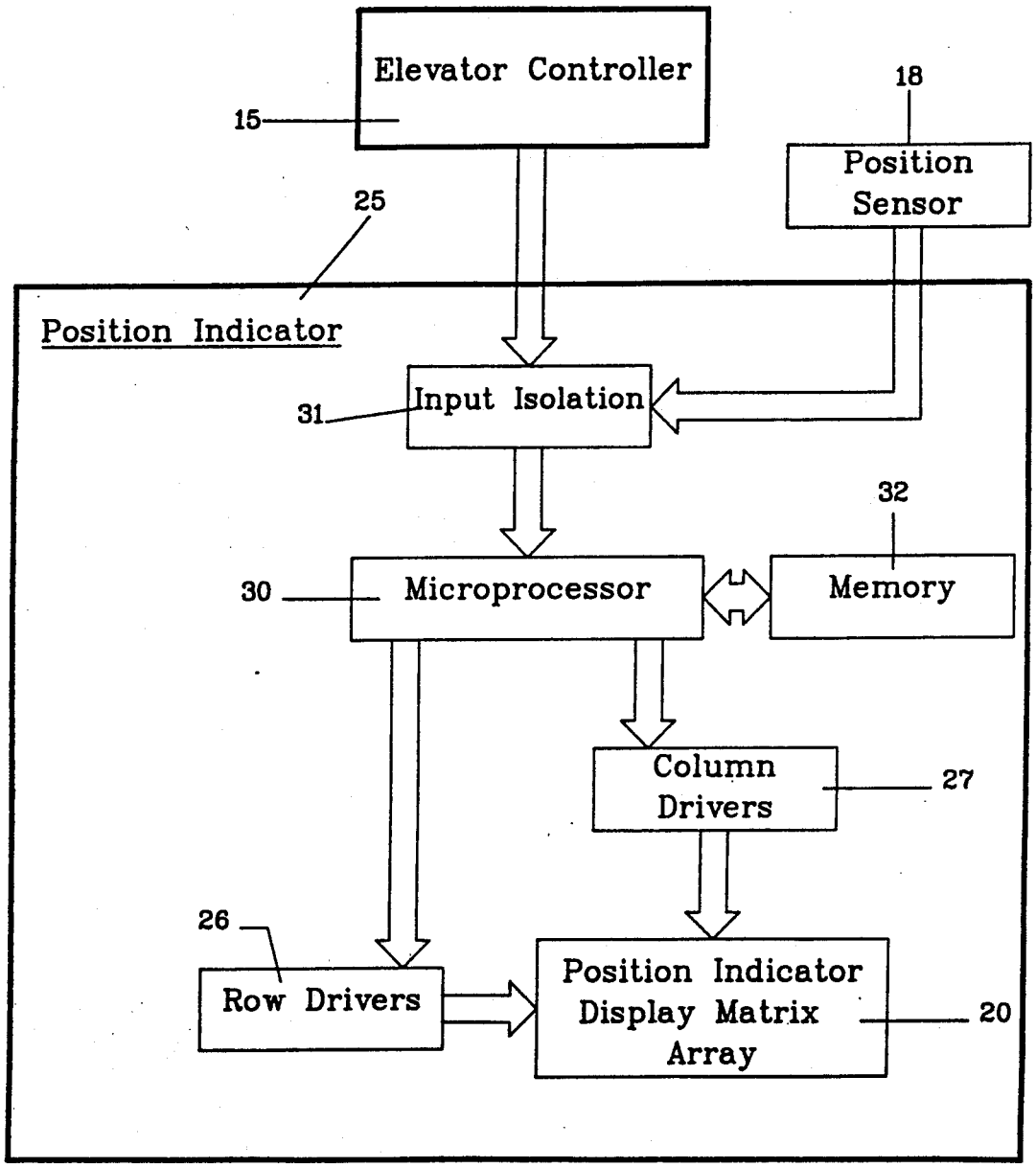
FIG. 2 is a block diagram of the invention.

The present invention concerns an improved elevator car position indicator, shown generally in FIG. 2 at 25, which scrolls a character representing the position of the elevator car 10 across the display screen 20 as the car 10 moves. Various visual display screens may be used, for example, a small cathode ray tube and associated circuitry could scroll a position indication across the display. The preferred embodiment of the invention is illustrated in FIG. 2, which includes a position indicator matrix array of Light Emitting Diodes (LEDs) as the display screen 20.

The display screen 20 can be assembled by placing a number of commercially available 5×7 LED matrix arrays side by side and end to end. A typical 5×7 array that could be used is Hewlett Packard Part No. HDSP-4701. Six 5×7 arrays can be arranged to provide a 10×21 display screen having 210 elements. Generally, as the number of elements in the display is increased, the resolution of the position indicator character will be enhanced.

The display screen 20 is connected to row drivers 26 and column drivers 27. Row and column drivers are well know in the art and include electronic switches which are responsive to binary coded data inputs to selectively illuminate individual LEDs. The LEDs are illuminated by the drivers 26 and 27 to form an elevator car position indication character, such as the number of the current floor. The position indication character can also be a symbol or letter, such as the silhouette of an automobile for a parking level or the letter "L" for the Lobby.

The row and column drivers 26 and 27 are controlled by a four or eight bit microprocessor 30, such as one of the Motorola 6800 Series microprocessors. The microprocessor 30 receives elevator car position and movement signals through an isolation means 31 which electrically isolates the input signal sources from the microprocessor 30. This is done to protect against extraneous signals, which may damage digital circuitry, and to provide compatibility with a range of input voltage levels. One method of isolating the microprocessor 30 is by using optoisolators. A typical optoisolator that is readily available is General Electric Part No. 4N28. The isolation means 31 receives input signals from the elevator controller 15, the shaft car position sensors 18 or a combination of the two. The microprocessor accesses a memory unit 32 which stores data tables containing the character codes for the display matrix array 20 and the software for operating the row and column drivers 26 and 27.

The operation of the position indicator will now be described. Upon receipt of a position signal, the microprocessor 30 converts the position signal into an elevator car location. The microprocessor 30 then accesses a corresponding location in the memory unit 32 to sequentially withdraw a binary row code and column code for the desired position indicator character. The particular memory location that was accessed is marked with a pointer. The codes are loaded into the row driver 26 and the column driver 27. The drivers 26 and 27 use the codes to illuminate specific elements of the display matrix array 20 to form the position indicator. The microprocessor 30 continually updates the drivers at a rate such that the character displayed on the matrix array 20 appears to be continuously illuminated. As long as the elevator car 10 remains at a particular landing, the memory pointer does not move and the microprocessor 30 continues using the same binary codes to update the LED display 20. Thus, the symbol representing the car location will be displayed in a stationary mode.

When the elevator begins to move, the microprocessor 30 will go into a scrolling mode of operation. In this mode, a second pointer is placed in the memory unit 32 for a new character. The pair of pointers are then indexed, at predetermined time intervals, sequentially through the memory locations in a direction corresponding to the direction of the elevator car movement. The predetermined time intervals will be described below. As a result of the pointer movement, new binary codes will be input to the matrix drivers 26 and 27 during the display updates. When the display is updated with the new codes, the displayed indicator character is indexed vertically across the screen 20. Furthermore, the next indicator stored in the memory 32 will move vertically onto the display screen 20.

Figure 3A:
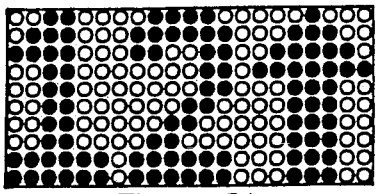
FIGS. 3A through 3L illustrate the display provided by the invention as an elevator car travels upwardly from floor #12 to floor #13.
Figure 3B:
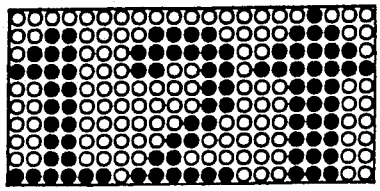
Figure 3C:
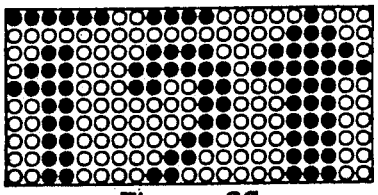
Figure 3D:
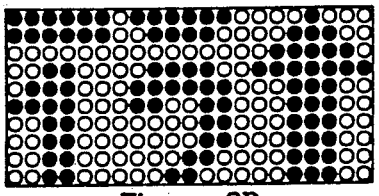
Figure 3E:
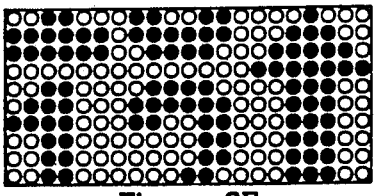
Figure 3F:
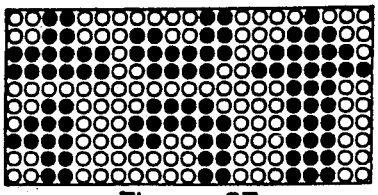
Figure 3G:
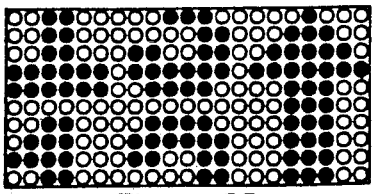
Figure 3H:
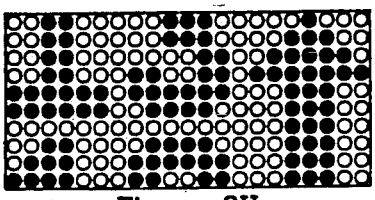
Figure 3I:
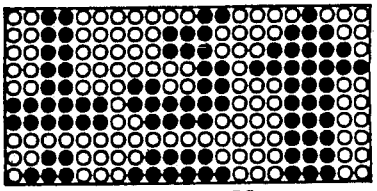
Figure 3J:
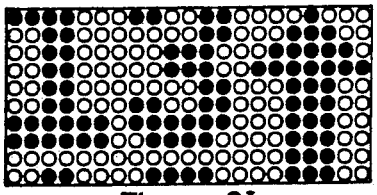
Figure 3K:
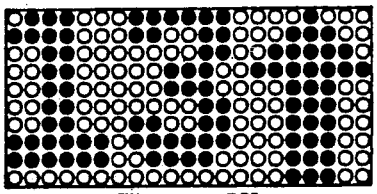
Figure 3L:
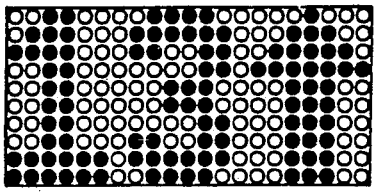
Figure 4A:
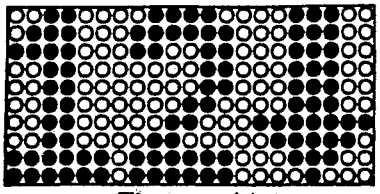
FIGS. 4A through 4L illustrate the display provided by the invention as an elevator car travels downwardly from floor #12 to floor #11.
Figure 4B:
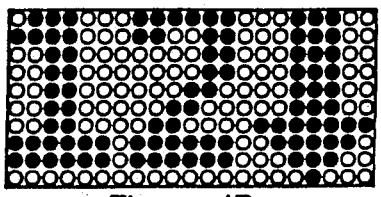
Figure 4C:
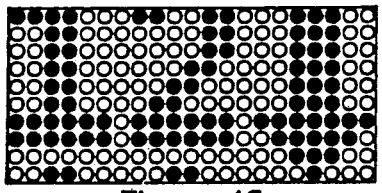
Figure 4D:
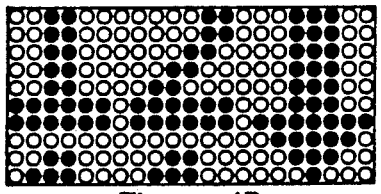
Figure 4E:
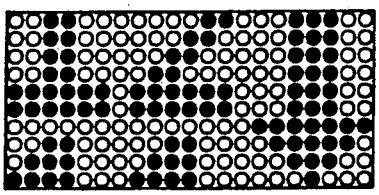
Figure 4F:
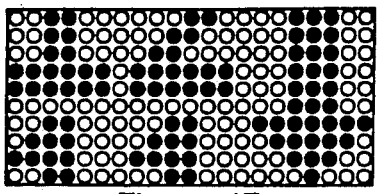
Figure 4G:
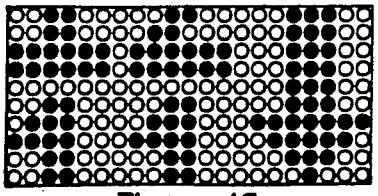
Figure 4H:
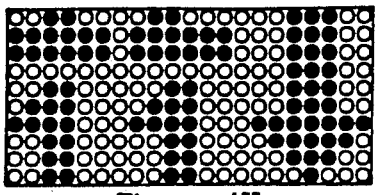
Figure 4I:
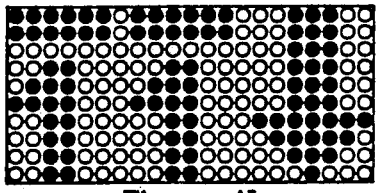
Figure 4J:
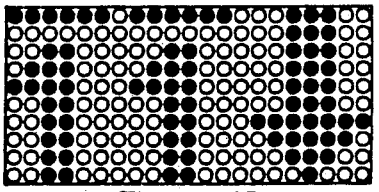
Figure 4K:
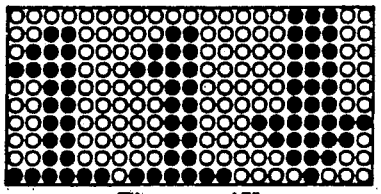
Figure 4L:
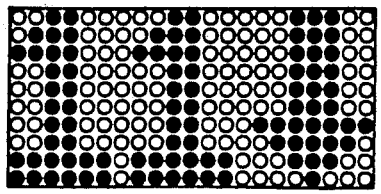

The scrolling mode of operation is best illustrated in FIGS. 3A through 3L wherein the elevator car 10 is being raised from floor #12 to floor #13. As the car moves, the old position indicator character, the number "12", is scrolled downwardly and off the bottom of the display screen 20. A new position indicator character, "13", is concurrently scrolled onto the display screen 20 from the top. FIG. 3A shows the old indicator character, the number "12", fully displayed on a matrix array having 10 rows and 21 columns for a total of 210 elements. In FIG. 3B, the row codes have been indexed by one, causing the number 12 to start a downward scroll. The arrow shown on the right portion of the display will be described below. In FIG. 3C, the rows have been indexed twice and the new position indicator character, the number "13", is beginning to appear at the top of the display. Indexing continues one row at a time until the display has been indexed a total number of times equal to the number of rows in the display plus one, which in this case would be 11. At this point, the new position indicator will be fully displayed, as shown in FIG. 3L. The additional indexing increment provides a blank line between the two characters to improve clarity. More than one blank line may be inserted, if desired.

The scrolling rate is determined by the time interval between indexing of the memory pointers. The time interval is adjusted by setting a software variable or an external input so that the new indicator character will be fully displayed as the car 10 arrives at the new location.

With the present invention, it is possible to hold a portion of the display stationary as the position indicator is scrolled. Thus the "UP ARROW" shown in FIGS. 3A through 3L is held in position while numeric indicators are scrolled across the display. An example of the display for a car moving down from floor #12 to floor #11 is illustrated in FIGS. 4A through 4L where the position indicator characters are scrolled in an upward vertical direction. The stationary arrow in FIGS. 4A through 4L is reversed from the arrow shown in FIGS. 3A through 3L to indicate the downward car direction.

The display screen 20 can be fabricated from LED arrays which include two different colored LEDs for each element. The diodes in each element pair are connected in parallel but with opposing polarities so that one lights when the pair is forward biased and the other lights when the pair is reverse biased. By rapidly alternating the bias, the two diodes will flash with a blending of colors to produce a third color. The diodes are off when the same bias is applied to both ends. Thus, if a matrix element consists of a blue and a yellow LED, three colors are possible, blue, yellow, and green which is the the combination of blue and yellow. With these colors, a blue display could indicate upward motion, a yellow, downward, and green could be used when the car is stationary awaiting passengers.

The use of colors allows the illumination of the background in a contrasting color from the position indicator character. Also, different colors could be used for the display characters. For example, in FIG. 3A, the numeric indicator could be one color and the direction arrow a second color.

Figure 5A:
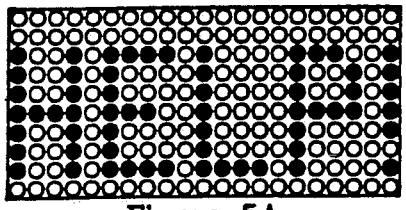
FIGS. 5A through 5c illustrate several message displays provided by the invention.
Figure 5B:
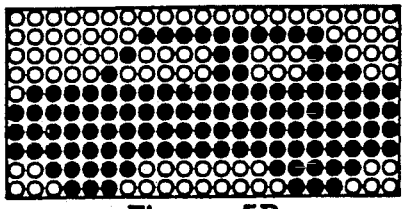
Figure 5C:
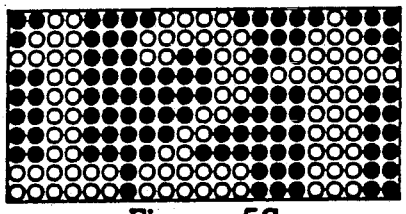

The same display described above can be used for the landing display screens 22. The scrolling of the position indicator character across the landing display screen 22 would inform waiting passengers of the car's progress towards them. A display could also be included in a central security panel (not shown) of a building. Such security panels are normally manned. As an aid in signaling security personnel, the memory 32 can store codes for displaying messages, such as the word "HELP" illustrated in FIG. 5A. This message would supplement the usual alarm bell available in an elevator car. In addition, such a visual message would inform a deaf person that a signal was being transmitted. The message would alternate with the car position indicator, thus alerting the security guard of both the problem and the exact location. More attention can be drawn to the display by reversing the display colors. Other messages can include a silhouette of an automobile, which is shown in FIG. 5B as an example of a symbolic message. An example of reversed colors is shown in FIG. 5C for the display of FIG. 3A.

Thus, the present invention provides an improved elevator position display which informs a car occupant of his progress towards his destination. In accordance with the provisions of the patent statutes, the principle and mode of operation of this invention have been explained and illustrated in its preferred embodiment. However, it must be understood that this invention may be practiced otherwise than as specifically explained and illustrated without departing from the scope of the attached claims.

I claim:

1. A display for indicating the position of an elevator car which is vertically moveable in either an upward or downward direction between a plurality of stops, said display comprising:

means for storing a plurality of position indicating characters, each of said position indicating characters being unique and corresponding to a particular one of the plurality of stops;

screen means connected to said storage means and responsive to the position of the elevator car for displaying a selected one of said plurality of position indicating characters when the elevator car is located at a selected one of the plurality of stops, said selected position indicating character corresponding to said selected stop; and control means connected to said storage means and said screen means, said control means responsive to movement of the elevator car from said selected one stop in an upward direction for vertically scrolling said selected one character in one direction on said screen means and responsive to movement of the elevator car in a downward direction for vertically scrolling said selected one character in an opposite direction on said screen means.

2. The display defined in claim 1 wherein said position indicating character is scrolled in a downward direction as the elevator car moves in an upward direction and said position indicating character is scrolled in an upward direction as the elevator car moves in a downward direction.

3. The display defined in claim 1 wherein said selected position indicating character is a first position indicating character, and further wherein said screen means is responsive to the position of the elevator car for displaying a second position indicating character when the elevator car is located at a second stop adjacent said selected one stop, said second position indicating character corresponding uniquely to said second stop, and said control means is operable to scroll said second position indicating character onto said screen means in the same direction as said first position indicating character as the elevator car approaches said second stop.

4. The display defined in claim 1 wherein said selected position indicating character is a first position indicating character, and further wherein said screen means is responsive to the position of the elevator car for displaying a second position indicating character when the elevator car is located at a second stop not adjacent to said selected one stop, said second position indicating character corresponding uniquely to said second stop, and said control means is operable to sequentially scroll position indicating characters representative of intermediate stops across said screen means in the same direction as said first position indicating character, and said control means is further operable to scroll said second position indicating character onto said screen means as the elevator car approaches said second stop.

5. The display defined in claim 3 wherein at least a portion of said first position indicating character is displayed simultaneously with at least a portion of said second position indicating character.

6. The display defined in claim 1 wherein said position indicating character is displayed upon a first portion of said screen means and said control means is responsive to the movement of the elevator car for displaying an arrow indicating the direction of the elevator movement upon said screen means, said arrow remaining stationary as said position indicating character is scrolled.

7. The display defined in claim 1 wherein said screen means includes a matrix of individual light emitting elements to display said position indicating character.

8. The display defined in claim 7 wherein each of said elements includes a plurality of light emitting devices operable to be illuminated in at least two different colors.

9. The display defined in claim 7 wherein said light emitting elements include light emitting diodes.

10. The display defined in claim 1 wherein said control means includes a microprocessor for controlling the scrolling of said selected character.

11. The display defined in claim 1 wherein said storage means includes a memory, said memory connected to said control means and having a plurality of codes stored therein and said control means selecting particular codes from said memory in response to the elevator car movement and using said codes for causing scrolling.

12. The display defined in claim 1 wherein said control means is responsive to a status change signal to cause said control means to alternately display the elevator car position and an informational message on said screen means.

13. The display defined in claim 1 and further including elevator control means for controlling the movement of the elevator car vertically in either an upward or downward direction and said screen means is electrically isolated from said elevator control means.

14. The display defined in claim 1 wherein said control means includes adjustment means for adjusting the rate of scrolling.

* * * * *